US009552908B2

(12) United States Patent
Lee

(10) Patent No.: US 9,552,908 B2
(45) Date of Patent: Jan. 24, 2017

(54) CHIP RESISTOR DEVICE HAVING TERMINAL ELECTRODES

(71) Applicant: National Cheng Kung University, Tainan (TW)

(72) Inventor: Wen-Hsi Lee, Tainan (TW)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 0 days.

(21) Appl. No.: 14/740,482

(22) Filed: Jun. 16, 2015

(65) Prior Publication Data

US 2016/0372242 A1 Dec. 22, 2016

(51) Int. Cl.
*H01C 1/146* (2006.01)
*H01C 1/14* (2006.01)

(52) U.S. Cl.
CPC ..... *H01C 1/146* (2013.01); *H01C 1/14* (2013.01)

(58) Field of Classification Search
CPC ..... H01C 1/146
See application file for complete search history.

(56) References Cited

U.S. PATENT DOCUMENTS 5,815,065 A * 9/1998 Hanamura ..... H01C 17/006 338/308
6,153,256 A * 11/2000 Kambara ..... H01C 17/006 29/613
6,242,999 B1 * 6/2001 Nakayama ..... H01C 1/14 338/307
7,907,046 B2 * 3/2011 Tsukada ..... H01C 1/012 29/621
2003/0132828 A1 * 7/2003 Hashimoto ..... H01C 1/14 338/203
2013/0321121 A1 * 12/2013 Ohbayashi ..... H01C 1/14 338/307
2016/0133362 A1 * 5/2016 Tsuda ..... H01C 7/003 338/322

FOREIGN PATENT DOCUMENTS

TW I264737 10/2006
TW I336201 1/2011
TW 1368238 7/2012

* cited by examiner

*Primary Examiner* — James Harvey

(74) *Attorney, Agent, or Firm* — Jackson IPG PLLC; Demian K. Jackson

(57) ABSTRACT

A chip resistor having terminal electrodes is provided. In the chip resistor, a first protector layer has a size different from that of a first resistor layer. Thus, two ends of the first resistor layer are exposed to form new current conduction path. Original current conduction path having the same size of the protective layer and the resistor layer is thus replaced. Hence, resistance variation of the chip resistor is solved; yield of the chip resistor is increased; and, the material cost of the front terminal electrode is greatly reduced.

9 Claims, 4 Drawing Sheets

CHIP RESISTOR DEVICE HAVING TERMINAL ELECTRODES

TECHNICAL FIELD OF THE INVENTION

The present invention relates to chip resistor; more particularly, relates to replacing an original current conduction path having the same size of a protective layer and a resistor layer by forming a new current conduction path having mutually different sizes of a protective layer and a resistor layer for solving resistance variation of chip resistor and further increasing yield of chip resistor while material cost of front terminal electrode is greatly reduced.

DESCRIPTION OF THE RELATED ARTS

Resistance of a chip resistor is mainly decided by the material and geometry of the resistor layer. After being conducted through front terminal electrodes, the chip resistor is connected to a printed circuit board (PCB) through electroplated nickel and tin. Basically, the terminal electrodes of the chip resistor can be divided into three parts, which are namely front terminal electrodes, back terminal electrodes and side terminal electrodes. Therein, the side terminal electrodes and the back terminal electrodes are used for plated nickel and tin seed in post. The front terminal electrodes are used not only for plated nickel and tin seed in post, but also for connecting the resistor layer, where the chip resistor is soldered after connecting the resistor layer and the plated nickel and tin (e.g. U.S. Pat. No. 6,153,256). Surely, there are prior arts which use the back terminal electrodes to connect the resistor layer, whose ideas are the same as those of the front terminal electrodes. Yet, the conductivity of the front terminal electrode must be much lower than the resistivity of the resistor layer to form an ohmic contact with the resistor layer; or else, parasitic resistance will affect the final resistance of the resistor. The error of the resistance must be precisely controlled within a small range (±1~3%). Or, a resistor having a low resistance is required. In summary, the requirement for the conductivity of the front terminal electrode is high. However, when the resistance of the resistor layer becomes increasingly lower, the resistance of the front terminal electrode must be kept lower than that of the resistor layer. The front terminal electrode is usually a paste silver ink composed of silver, glass and organic adhesive (U.S. Pat. No. 6,153,256). It is necessary to increase the solid content of silver in the paste silver ink for reducing resistance. However, the higher the solid content of silver, the more expensive the price. As a result, the cost of the front terminal electrode is greatly increased. In addition, for a low-resistance resistor, even through the front terminal electrode is made to have a lower resistance than that of the resistor layer, the final resistance of the entire resistor will still be affected to make a narrow-variation low-resistance resistor become hard to control. Hence, the prior art does not fulfill all users' needs in actual use.

SUMMARY OF THE INVENTION

The main purpose of the present invention is to change the current conduction path by using mutually different sizes of a protective layer and a resistor layer, where the resistor layer is originally conducted through printed front terminal electrodes and then is changed to be conducted through electroplated layers.

Another purpose of the present invention is to provide plated nickel having better conductivity than that of printed silver, where the plated nickel is directly connected to a low-resistance resistor layer for significantly reduce the parasitic resistance effect of the resistor layer; and the low-resistance resistor layer helps enhancing yield of electrical tests of resistor layers.

Another purpose of the present invention is to use printed silver on a front surface as a seed layer for forming plated nickel in post, where printed silver is not required for conducting the resistor layer; conductivity of front terminal electrode only has to suit the plated nickel; and not only a printed silver having a low silver content with low cost but also other low-cost metals having low conductivities can be used, which is advantageous for reducing the material cost of the chip resistor.

To achieve the above purposes, the present invention is a chip resistor device having terminal electrodes, comprising a substrate, two front terminal electrodes, two back terminal electrodes, a first resistor layer, a first protector layer and two side terminal electrodes, where the substrate has a front surface, a back surface and two side surfaces; the front terminal electrodes are formed on the front surface of the substrate, separated with each other, and separately aligned along the side surfaces of the substrate; the back terminal electrodes are formed on the back surface of the substrate, separated with each other, and separately aligned along the side surfaces of the substrate; the first resistor layer is formed on the front surface and located between the front terminal electrodes; a part of each of two ends of the first resistor layer overlaps at least a part of one of the front terminal electrodes separately; the first protector layer overlaps the first resistor layer; a size of the first protector layer is different from a size of the first resistor layer to form an exposed area at each of the two ends of the first resistor layer separately; the side terminal electrodes are formed on the side surfaces of the substrate; each of the side terminal electrodes is separately connected to one of the front terminal electrodes and one of the back terminal electrodes at the same side; a part of each of the side terminal electrodes overlaps the exposed area at one of the two ends of the first resistor layer; and a current is directly conducted to the first resistor layer through the side terminal electrodes. Accordingly, a novel device of chip resistor with terminal electrodes is formed.

BRIEF DESCRIPTION OF THE DRAWINGS

The present invention will be better understood from the following detailed description of the preferred embodiments according to the present invention, taken in conjunction with the accompanying drawings, in which.

DESCRIPTION OF THE PREFERRED EMBODIMENTS

Figure 1:
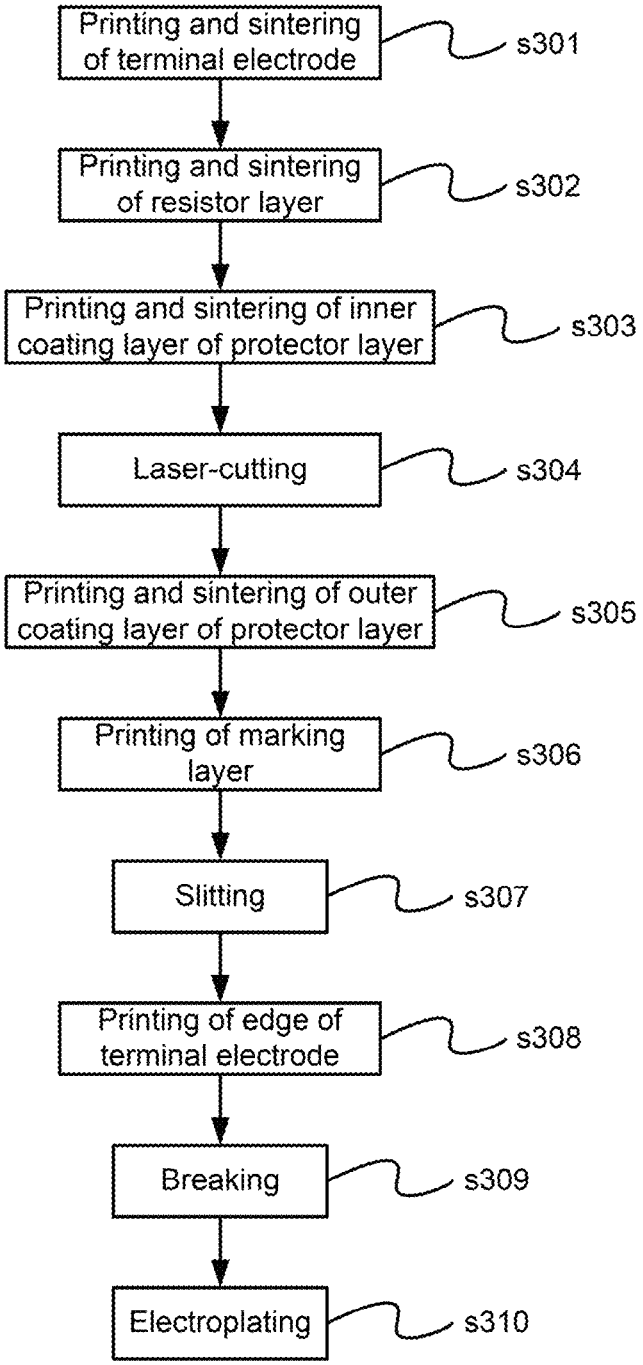
FIG. 1 is the flow view showing the producing process of the first preferred embodiment according to the present invention.

The following description of the preferred embodiments is provided to understand the features and the structures of the present invention.

Please refer to FIG. 1~FIG. 4, which are a flow view showing a producing process of a first preferred embodiment according to the present invention; a view showing comparison of current conduction paths for the present invention; a sectional view showing a second preferred embodiment; and a view showing comparison of resistance distributions. As shown in the figures, the present invention is a chip resistor device having terminal electrodes, where a first preferred embodiment comprises a substrate 11, two front terminal electrodes 12, two back terminal electrodes 13, a first resistor layer 14, a first protector layer 15 and two side terminal electrodes 16, as shown in FIG. 2(*b*).

The substrate 11 has a front surface 111, a back surface 112 and two side surfaces 113.

The front terminal electrodes 12 are formed on the front surface 111 of the substrate 11; separated with each other; and separately aligned along the side surfaces 113 of the substrate 11.

The back terminal electrodes 13 are formed on the back surface 112 of the substrate 11; separated with each other; and separately aligned along the side surfaces 113 of the substrate 11.

The first resistor layer 14 is formed on the front surface 111 of the substrate 11 and located between the front terminal electrodes 12; and a part of each of two ends of the first resistor layer 14 overlaps at least a part of one of the front terminal electrodes 12 separately.

The first protector layer 15 overlaps the first resistor layer 14; and a size of the first protector layer 15 is different from a size of the first resistor layer 14 to form an exposed area at each of the two ends of the first resistor layer 14 separately. The size of the first protector layer 15 is at least 1 micrometer (μm) smaller than the size of the first resistor layer 14. The first protector layer 15 has an inner coating layer 151 mainly made of glass and connected to a surface of the first resistor layer 14; and an outer coating layer 152 mainly made of epoxy resin and connected to a surface of the inner coating layer 151.

The side terminal electrodes 16 are formed on the side surfaces 113 of the substrate 11; each of said side terminal electrodes 14 is separately connected to one of the front terminal electrodes 12 and one of the back terminal electrodes 13 at the same side; and a part of each of the side terminal electrodes 16 overlaps the exposed area of each of the two ends of the first resistor layer 14 for directly conducting the first resistor layer 14 through the side terminal electrode 16.

The present invention can further comprise two plating layers 17, which are formed upwardly from the surfaces of the side terminal electrodes 16 separately.

Thus, a novel device of chip resistor with terminal electrodes is formed.

Figure 3:
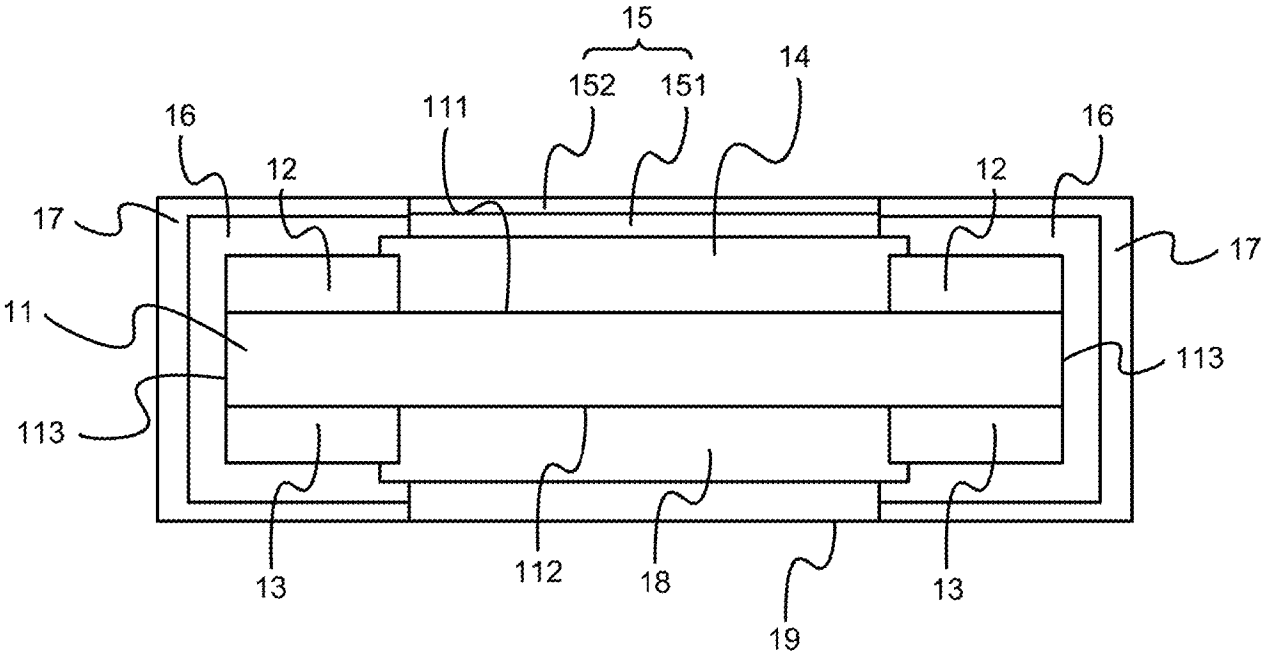
FIG. 3 is the sectional view showing the second preferred embodiment.

A second preferred embodiment is shown in FIG. 3. The present invention can further comprise a second resistor layer 18 and a second protector layer 19. The second resistor layer 18 is formed on the back surface of the substrate 11 and located between the back terminal electrodes 13; and a part of each of two ends of the second resistor layer 18 overlaps at least a part of one of the back terminal electrodes 13 separately. The second protector layer 19 overlaps the second resistor layer 18; and a size of the second protector layer 19 is at least 1 μm smaller than a size of the second resistor layer 18 to form an exposed area at each of the two ends of the second resistor layer 18 separately. Each of the side terminal electrodes 16 is separately formed on one of the side surfaces of the substrate 11 and connected to one of the front terminal electrodes 12 and one of the back terminal electrodes 13 at the same side. A part of each of the side terminal electrodes 16 overlaps the exposed area of each of the two ends of the first resistor layer 14 and the exposed area of each of the two ends of the second resistor layer 18, so that a current is directly conducted to the first resistor layer 14 and the second resistor layer 18 through the side terminal electrodes 16.

Figure 2A:
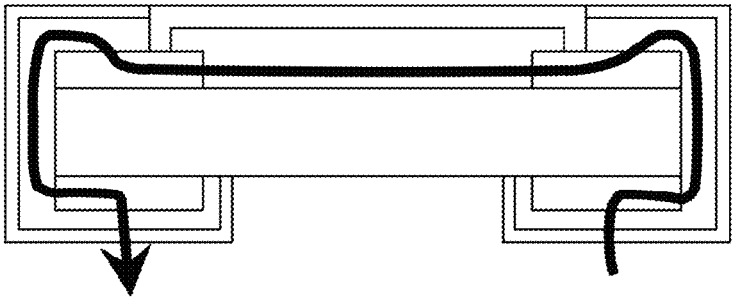
FIGS. 2(A) and 2(B) are views showing the comparison of the current conduction paths for the present invention.

The above terminal electrodes of chip resistor are made through thick film printing with alumina ceramic, which includes the processes of printing and sintering of a terminal electrode, printing and sintering of a resistor layer, printing and sintering of an inner coating layer of protector layer, laser-cutting, printing and sintering of an outer coating layer of protector layer, printing of a marking layer, wrapping, printing of an edge of terminal electrode, breaking, and electroplating. In FIG. 1, the first preferred embodiment is fabricated through the following steps:

Printing and sintering of terminal electrode s301: At first, two back terminal electrodes 13 are formed at proper places on a back surface 112 of a substrate 11 by printing. Then, two front terminal electrodes 12 are formed at proper places on a front surface 111 of the substrate 11 by printing. Then, the substrate 11 is sent into a sintering furnace for processing sintering operation at a high temperature of 850 Celsius degrees (° C.), so that the back terminal electrodes 13 and the front terminal electrodes 12 are sintered with the substrate 11. Therein, the front terminal electrodes 12 are made of metals having conductivity and cost lower than those of silver, like aluminum or copper; or made of low-cost silver-containing metals having low silver contents for printing.

Printing and sintering of resistor layer s302: A first resistor layer 14 is formed between two adjacent front terminal electrodes 12 on the substrate 11 by printing 12 and two ends of the first resistor layer 14 are connected to the front terminal electrodes 12. Then, the substrate is sent into a sintering furnace for processing sintering operation at a high temperature of 850° C., so that the first resistor layer 14 is sintered with the substrate 11.

Printing and sintering of an inner coating layer of protector layer s303: An inner coating layer 151 of a first protector layer 15 is formed on the first resistor layer 14 by printing after the sintering operation. A size of the inner coating layer 151 is smaller than that of the first resistor layer 14 to form an exposed area at each of the two ends of the first resistor layer 14 separately. Then, the substrate 11 is sent into a sintering furnace for processing sintering operation at a high temperature of 600° C., so that the inner coating layer 151 of the first protector layer 15 is sintered with the first resistor layer 14. Therein, the inner coating layer 151 of the first protector layer 15 is insulated and mainly made of glass.

Laser-cutting s304: The substrate 11 is sent into a laser-cutting device. A laser light is used to process cutting to the first resistor layer 14 on the inner coating layer 151 of the first protector layer 15 for obtaining an adjusting trough with a proper shape (such as '|', '-', '⌊', etc.) to modify resistance of the first resistor layer 14.

Printing and sintering of an outer coating layer of protector layer s305: An outer coating layer 152 of the first protector layer 15 is further formed on the inner coating layer 151 of the first protector layer 15 by printing to form the complete first protector layer 15. Then, the substrate 11 is sent into a sintering furnace for processing using a sintering operation at a temperature of 200° C., so that the outer coating layer 152 of the first protector layer 15 is sintered with the inner coating layer 151. Therein, the outer coating layer 152 and the inner coating layer 151 are the same size to show the exposed areas at the two ends of the first resistor layer 14; and, the outer coating layer 152 of the first protector layer 15 is insulated and mainly made of epoxy resin.

Printing of marking layer s306: On the first protector layer 15, related identification marks representing the chip resistor are printed, such as model number, resistance value, etc.

Slitting s307: A plate of the substrate 11 is sent to a roller press for slitting the substrate 11 into strips.

Printing of edge of terminal electrode s308: After being slitted, the substrate 11 is printed with conductive material on two side surfaces, so that side terminal electrodes 16 are formed and the front terminal electrode 12 and the back terminal electrode 13 aligned along the same side are connected to each other by the corresponding side terminal electrode 16. Then, the slitted substrate 11 formed after forming the side terminal electrodes 16 is sent into a sintering furnace for processing sintering operation at a temperature of 200° C., so that the side terminal electrodes 16 are sintered with the front terminal electrodes 12 and the back terminal electrodes 13. Therein, the side terminal electrode 16 is made of a material selected from copper, nickel, tin or a combination thereof.

Breaking s309: The substrate 11 formed after being sintered with the side terminal electrodes 16 is further broken by the roller press to be cut into independent dices, where each dice comprises two front terminal electrodes 12, two back terminal electrodes 13, two side terminal electrodes 16, a first resistor layer 14 and a first protector layer 15; and where the first protector layer 15 comprises an inner coating layer 151 and an outer coating layer 152.

Electroplating s310: The dice, which is a chip resistor with terminal electrodes, is sent to a tank for electroplating operation. Therein, an electroplated layer 17 is plated outside each side terminal electrode 16. Thus, the present invention, a device of chip resistor with terminal electrodes, is fabricated.

Figure 2B:
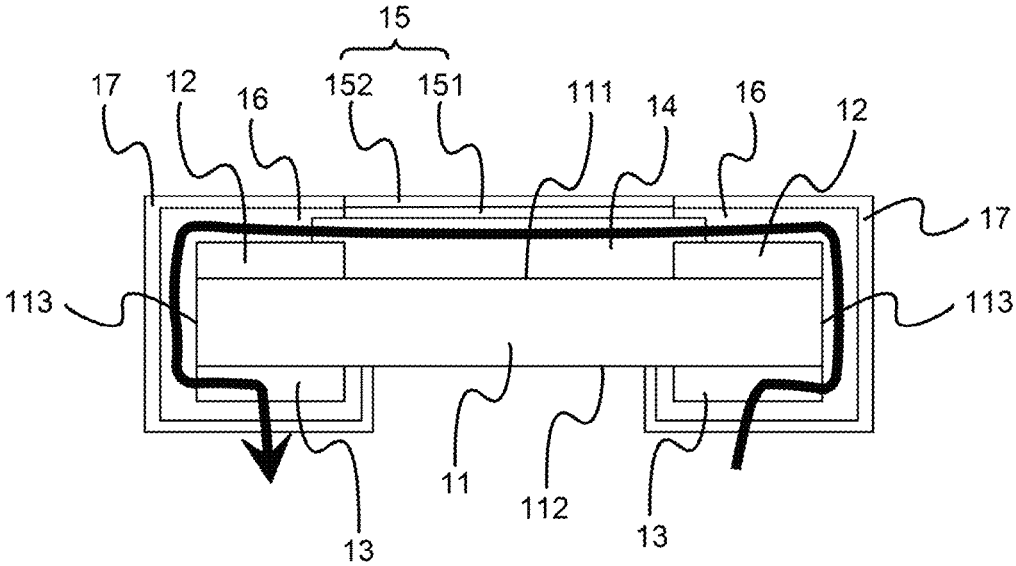

In FIG. 2(B), the present invention changes current conduction path by using mutually different sizes of a protective layer and a resistor layer. Originally, a resistor layer is conducted through printed front terminal electrodes in FIG. 2(A); yet, the resistor layer is changed to be conducted through electroplated layers in FIG. 2(B). As a result, three terminal electrodes of a chip resistor, including a front terminal electrode, a side terminal electrode and a back terminal electrode, are only used for forming plated nickel and tin in post with a seed layer. The present invention simplifies the function of the front terminal electrode, so that conductivity of the front terminal electrode becomes similar to that of the side terminal electrode and that of the back terminal electrode. Hence, only the process of plating a seed layer for forming plated nickel and tin in post have to be taken into consideration; and, ohmic contacts do not have to be changed according to the change in resisting rate of the resistor layer.

Figure 4B:
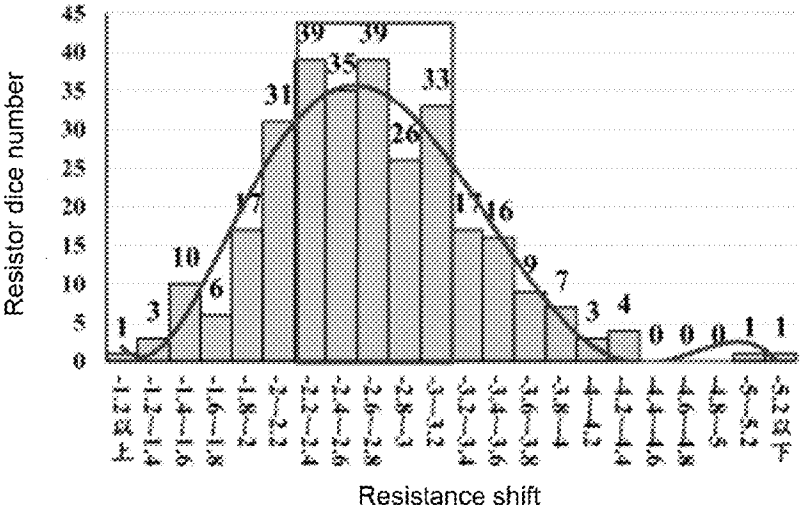
FIGS. 4(A) and 4(B) are views showing the comparison of the resistance distributions.
Figure 4A:
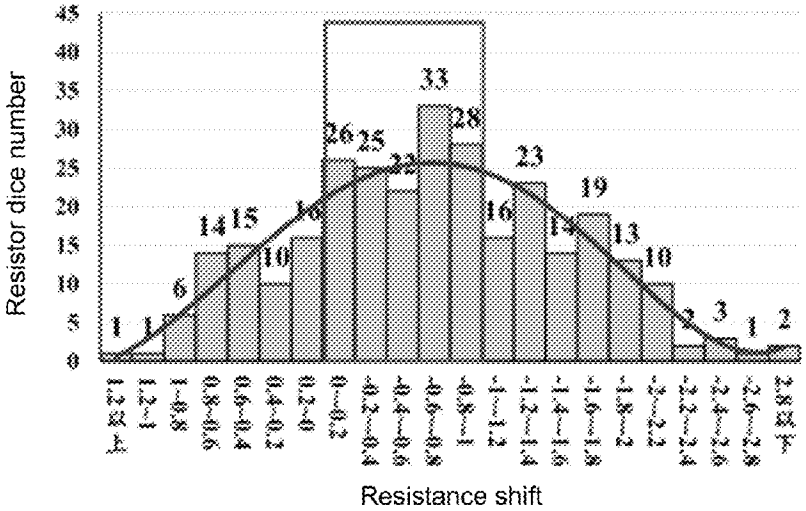

FIG. 4(A) shows a resistance distribution when the protective layer and the resistor layer have the same size; and, FIG. 4(B) shows another resistance distribution when the protective layer and the resistor layer mutually have different sizes. Conclusively, by forming new current conduction path having mutually different sizes of the protective layer and the resistor layer, original current conduction path having the same size of the protective layer and the resistor layer is replaced for solving the problem of resistance variation of the chip resistor and further increasing yield of the chip resistor having narrow-distribution resistance.

Thus, the present invention uses mutually different sizes of a protective layer and a resistor layer to change current conduction path, where the resistor layer is originally conducted through printed front terminal electrodes and then is changed to be conducted through electroplated layers. The present invention has the following two advantages:

1. Conductivity of nickel is better than that of printed silver. Therefore, the use of plated nickel for directly connecting a low-resistance resistor layer can significantly reduce the parasitic resistance effect of the resistor layer, and this effect is especially important for the low-resistance resistor layer to help enhance the yield of electrical tests of the resistor layer. Therein, regarding using nickel to connect the resistor layer, the low-resistance resistor layer has a far lower resistance rate than the resistor, so that the final resistance of the entire resistor is not affected and the resistance of the chip resistor having narrow-distribution resistance can be easily controlled.

2. When the printed silver on the front surface is not used to conduct the resistor layer but to function as the seed layer for forming plated nickel in post, conductivity of the front terminal electrode only has to suit that of the plated nickel. Hence, not only a printed silver having a low silver content with low cost but also other low-cost metals having low conductivities (such as aluminum, copper, etc.) can be used, which is advantageous for reducing material cost of the chip resistor.

In summary, the present invention is a chip resistor device having terminal electrodes, where, by forming new current conduction path having mutually different sizes of a protective layer and a resistor layer, original current conduction path having the same size of the protective layer and the resistor layer is replaced for solving resistance variation of chip resistor and further increasing yield of chip resistor while material cost of front terminal electrode is greatly reduced.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. A chip resistor device having terminal electrodes, comprising:

a substrate, said substrate having a front surface, a back surface and two side surfaces;

two front terminal electrodes, said front terminal electrodes being formed on said front surface of said substrate, said front terminal electrodes being separated with each other, said front terminal electrodes being separately aligned along said side surfaces of said substrate;

two back terminal electrodes, said back terminal electrodes being formed on said back surface of said substrate, said back terminal electrodes being separated with each other, said back terminal electrodes being separately aligned along said side surfaces of said substrate;

a first resistor layer, said first resistor layer being formed on said front surface and located between said front terminal electrodes, a part of each of two ends of said first resistor layer overlapping at least a part of one of said front terminal electrodes separately;

a first protector layer, said first protector layer overlapping said first resistor layer, a size of said first protector layer being different from a size of said first resistor layer to obtain an exposed area at each of said two ends of said first resistor layer separately; and two side terminal electrodes, said side terminal electrodes being formed on said side surfaces of said substrate, each of said side terminal electrodes being separately connected to one of said front terminal electrodes at the same side and one of said back terminal electrodes at the same side, a part of each of said side terminal electrodes overlapping said exposed area of each of said two ends of said first resistor layer, wherein a current is directly conducted to said first resistor layer through said side terminal electrodes, wherein said size of said first protector layer is at least 1 micrometer (μm) smaller than said size of said first resistor layer.

2. A chip resistor device having terminal electrodes, comprising:

a substrate, said substrate having a front surface, a back surface and two side surfaces;

two front terminal electrodes, said front terminal electrodes being formed on said front surface of said substrate, said front terminal electrodes being separated with each other, said front terminal electrodes being separately aligned along said side surfaces of said substrate;

two back terminal electrodes, said back terminal electrodes being formed on said back surface of said substrate, said back terminal electrodes being separated with each other, said back terminal electrodes being separately aligned along said side surfaces of said substrate;

a first resistor layer, said first resistor layer being formed on said front surface and located between said front terminal electrodes, a part of each of two ends of said first resistor layer overlapping at least a part of one of said front terminal electrodes separately;

a first protector layer, said first protector layer overlapping said first resistor layer, a size of said first protector layer being different from a size of said first resistor layer to obtain an exposed area at each of said two ends of said first resistor layer separately;

two side terminal electrodes, said side terminal electrodes being formed on said side surfaces of said substrate, each of said side terminal electrodes being separately connected to one of said front terminal electrodes at the same side and one of said back terminal electrodes at the same side, a part of each of said side terminal electrodes overlapping said exposed area of each of said two ends of said first resistor layer, wherein a current is directly conducted to said first resistor layer through said side terminal electrodes;

a second resistor layer, said second resistor layer being obtained on said back surface of said substrate and located between said back terminal electrodes, a part of each of two ends of said second resistor layer overlapping at least a part of one of said back terminal electrodes separately; and a second protector layer, said second protector layer overlapping said second resistor layer, a size of said second protector layer being different from a size of said second resistor layer to obtain an exposed area at each of said two ends of said second resistor layer separately.

3. The device according to claim 2, wherein said size of said second protector layer is at least 1μm smaller than said size of said second resistor layer.

4. A chip resistor device having terminal electrodes, comprising a substrate, said substrate having a front surface, a back surface and two side surfaces;

two front terminal electrodes, said front terminal electrodes being formed on said front surface of said substrate, said front terminal electrodes being separated with each other, said front terminal electrodes being separately aligned along said side surfaces of said substrate;

two back terminal electrodes, said back terminal electrodes being formed on said back surface of said substrate, said back terminal electrodes being separated with each other, said back terminal electrodes being separately aligned along said side surfaces of said substrate;

a first resistor layer, said first resistor layer being formed on said front surface and located between said front terminal electrodes, a part of each of two ends of said first resistor layer overlapping at least a part of one of said front terminal electrodes separately;

a first protector layer, said first protector layer overlapping said first resistor layer, a size of said first protector layer being different from a size of said first resistor layer to obtain an exposed area at each of said two ends of said first resistor layer separately;

two side terminal electrodes, said side terminal electrodes being formed on said side surfaces of said substrate, each of said side terminal electrodes being separately connected to one of said front terminal electrodes at the same side and one of said back terminal electrodes at the same side, a part of each of said side terminal electrodes overlapping said exposed area of each of said two ends of said first resistor layer, wherein a current is directly conducted to said first resistor layer through said side terminal electrodes;

a second resistor layer, said second resistor layer being obtained on said back surface of said substrate and located between said back terminal electrodes, a part of each of two ends of said second resistor layer overlapping at least a part of one of said back terminal electrodes separately; and a second protector layer, said second protector layer overlapping said second resistor layer, a size of said second protector layer being different from a size of said second resistor layer to obtain an exposed area at each of said two ends of said second resistor layer separately, wherein a part of each of two side terminal electrodes overlaps said exposed area of each of said two ends of said first resistor layer and said exposed area of each of said two ends of said second resistor layer; and a current is directly conducted to said second resistor layer through said side terminal electrodes.

5. The device according to claim 4, wherein said size of said second protector layer is at least 1 μm smaller than said size of said second resistor layer.

6. The device according to claim 1, wherein said first protector layer has an inner coating layer mainly made of glass and connected to a surface of said first resistor layer; and an outer coating layer mainly made of epoxy resin and connected to a surface of said inner coating layer.

7. The device according to claim 1, wherein said front terminal electrodes are made of metals having conductivity and cost lower than those of silver.

8. The device according to claim 1,
wherein said side terminal electrodes are made of metals selected from a group consist of copper, nickel and tin.

9. The device according to claim 1, further comprising
two plating layers, said plating layers overlapping said side terminal electrodes separately.

* * * * *